US005078053A

United States Patent [19]

Denis

[11] Patent Number: 5,078,053

[45] Date of Patent: Jan. 7, 1992

[54] SYSTEM FOR SECURING SUB-MUNITIONS PLACED ON BOARD A CARRIER

[75] Inventor: Jean-François Denis, Checy, France

[73] Assignee: Thomson-Brandt Armements, Boulogne Billancourt, France

[21] Appl. No.: 628,705

[22] Filed: Dec. 17, 1990

[30] Foreign Application Priority Data

Dec. 22, 1989 [FR] France ..... 89 17088

[51] Int. Cl.[5] ..... B64D 1/04; F42B 12/60

[52] U.S. Cl. ..... 102/393; 89/1.51; 102/489

[58] Field of Search ..... 102/393, 489, 378, 377; 89/1.51

[56] References Cited

U.S. PATENT DOCUMENTS

| | | | |
|---|---|---|---|
| 2,395,913 | 3/1946 | Schultze | 102/393 |
| 2,604,043 | 2/1952 | Frisch et al. | 102/393 |
| 2,690,122 | 9/1954 | Darnall et al. | 102/393 |
| 2,972,946 | 2/1961 | Poulter | 102/393 |
| 3,513,512 | 5/1970 | Phillips | 102/377 |
| 4,524,694 | 6/1985 | Boeder | 102/393 |
| 4,558,645 | 12/1985 | Boeder | 102/489 |
| 4,879,941 | 11/1989 | Repé et al. | 102/393 |

FOREIGN PATENT DOCUMENTS 2562998 10/1985 France .

*Primary Examiner*—David H. Brown

*Attorney, Agent, or Firm*—Roland Plottel

[57] ABSTRACT

Disclosed is a system for securing sub-munitions on board a carrier. The system uses straps. Each strap is fixed by one end to a container wall by a tensioning means, and its other end is engaged in a cylindrical lock element mounted on another wall. The cylindrical lock element is connected to a resistant torque generator device which is itself connected to a torque limiting device which gets triggered at a determined threshold value, so as to release the cylindrical lock element in rotation in order to release the end of the strap. In these systems, the straps are released less suddenly than in the known systems, and they are released with perfect simultaneity. A development enables the sub-munitions to be ejected with controlled angles of incidence in relation to the trajectory of the carrier.

8 Claims, 6 Drawing Sheets

SYSTEM FOR SECURING SUB-MUNITIONS PLACED ON BOARD A CARRIER

BACKGROUND OF THE INVENTION

1. Field of the Invention

The present invention relates to a system for securing sub-munitions placed on board carriers such as rockets, missiles etc, these systems being of the type with straps.

2. Description of the Prior Art

Carriers for sub-munitions generally have them housed in individual compartments or containers which are associated with ejection means such as inflatable bags and are kept in a fixed position, for conveyance, by securing means which are released for their ejection.

In one presently known securing system, tenons are made in the rim of the sub-munition. These tenons are held by clamps that can be released mechanically, by means of rod assemblies. In these systems, the triggering of the ejection is subordinated to the prior release of the securing means. The result thereof is that the response time from an ejection command is not negligible and may adversely affect precision. Furthermore, these systems obligatorily call for the special designing or adapting of the sub-munitions, in that they are provided with adequate hooking tenons.

In other systems, the securing means are released by breaking: the sub-munitions are girdled by straps having embrittled zones or are fastened by screws that break under traction. As compared with the above systems, these systems have the advantage wherein the release is prompted by the triggering of the ejection itself. By contrast, the breaks generate shocks and stresses that are detrimental to the sub-munitions and are often totally unacceptable when these sub-munitions enclose sensitive devices. Furthermore, when the sub-munitions are hooked on at several points, namely with several straps or several screws, it is not possible to ensure that the breaks will take place with perfect simultaneity. This perfect simultaneity is, however, necessary for accurate ejection without any disturbing moment.

In practice, to mitigate this drawback as far as possible, there is a tendency to limit the number of securing means. In a system with straps for example, the sub-munitions are girdled by two straps only, on either side of a support. This approach, however, raises another problem concerning the distribution of the forces on the sub-munition: under the effect of the triggering of ejection, just before the break occurs, the reaction forces of the two straps, which are relatively far from each other, communicate a certain bending to the sub-munition. Naturally, the same problem arises with securing means using screws.

SUMMARY OF THE INVENTION

The aim of the invention is to provide for a system for securing sub-munitions in a carrier, wherein the release of said sub-munitions causes the smallest possible degree of shocks and stresses.

Another object of the invention is to provide a system such as this enabling the sub-munitions to be fastened at several points, so as to have a satisfactory distribution of the forces on these sub-munitions, without this multiple fastening system having any detrimental effect on the ejection.

According to the invention, there is proposed a system using straps, wherein each strap is fixed by a first end to a wall of the container reserved for a sub-munition through a means for placing said strap under tension. The second end of this strap includes a means of engagement in a cylindrical lock element which is mounted in another wall of said container, and it is connected to a device that sets up a countering resistant torque during a rotation of the cylindrical lock element in the direction in which the strap is put under tension, said resistant torque generator device being itself connected to a torque limiter device which is triggered at a determined threshold value, so as to release the cylindrical lock element in rotation in order to release said second end of the strap.

In one embodiment of a securing system according to the invention with a plurality of straps, all the cylindrical lock elements are coupled in series by means of linking bars, the assembly of cylindrical lock elements being connected to a single resistant torque generating device with which said torque limiting device is associated.

In another embodiment, the cylindrical lock elements are divided into two identical groups in each of which they are coupled in series, the two groups being linked respectively to each of two identical resistant torque generating devices, connected to a single torque limiting device, on either side of it. In a system limited to two straps, there is only one cylindrical lock element on either side.

In both these embodiments, the cylindrical lock elements act in a perfectly identical and perfectly synchronous manner so that, in the sub-munitions, the forces produced by the securing system are well distributed and so that, at ejection, the straps are released in a perfectly concomitant way.

BRIEF DESCRIPTION OF THE DRAWINGS

The invention will be understood clearly from the following explanations and from the appended drawings, of which.

DESCRIPTION OF PREFERRED EMBODIMENTS

Figure 1:
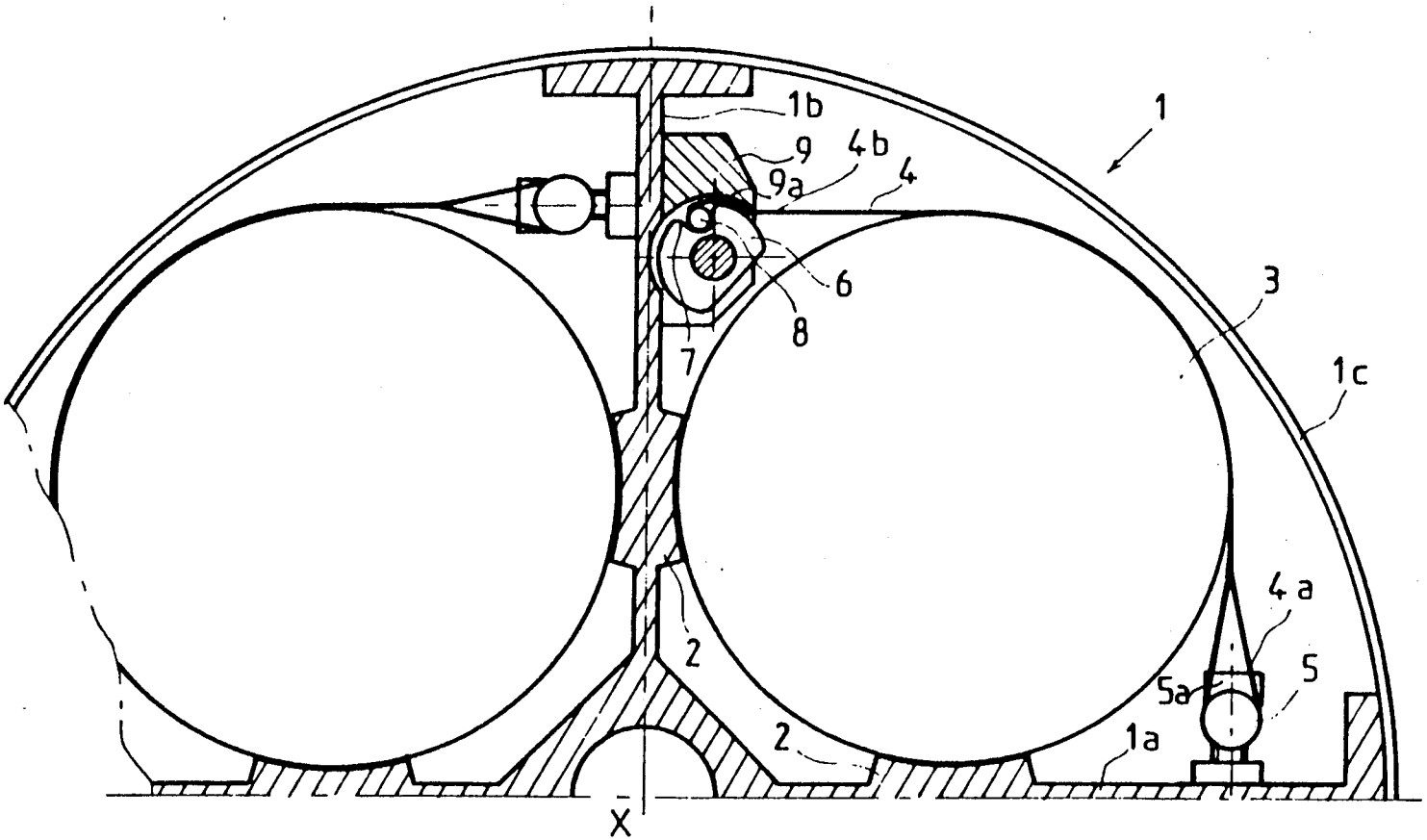
FIG. 1 is a schematic view, in a partial section, of a carrier conveying sub-munitions fastened by means of securing systems according to the invention.

The sub-munitions carrier shown in the drawings conventionally has a basic structure defining a plurality of compartments or containers 1 around the longitudinal axis X. These compartments 1 are bounded by two radial walls 1*a* and 1*b* and closed by an external wall 1*c* integrated into the frame. In each compartment 1, on the radial walls 1*a* and 1*b*, supports 2 are made. Sub-munitions 3 rest on these supports. Beneath the sub-munitions 3, between the supports 2, ejection means such as inflatable bags (not shown) are provided for.

Each sub-munition 3 is fastened in its own compartment by a strap 4 or, most commonly, by a group of such straps distributed longitudinally.

Each of the straps 4 is fixed by a first end 4*a* to a hooking means 5 mounted on one of the radial walls 1*a* of the compartment, towards the exterior with respect to the support 2. In accordance with the invention, the hooking means 5 is provided with a device enabling the strap to be gradually placed under tension, for example by using screws 5*a*.

On the other radial wall 1*b* of the compartment 1, in a position neighboring the external wall 1*c*, there is mounted a cylindrical lock element 6 with an axis parallel to the longitudinal axis X of the carrier and having, at its periphery, a groove 7 oriented along a generatrix line and designed to receive an element 8 having a complementary shape. This element 8 is fixedly joined to the second end 4*b* of the strap 4.

Besides, the cylindrical lock element 6 is mounted in a cover 9, one wall 9*a* of which overlaps a part of the circumference at a distance slightly greater than the thickness of the strap 4. When the element 8 is engaged in the groove 7, and when this groove 7 is facing the wall 9*a*, said element 8 cannot come out of the groove towards the strap 4.

Figure 2:
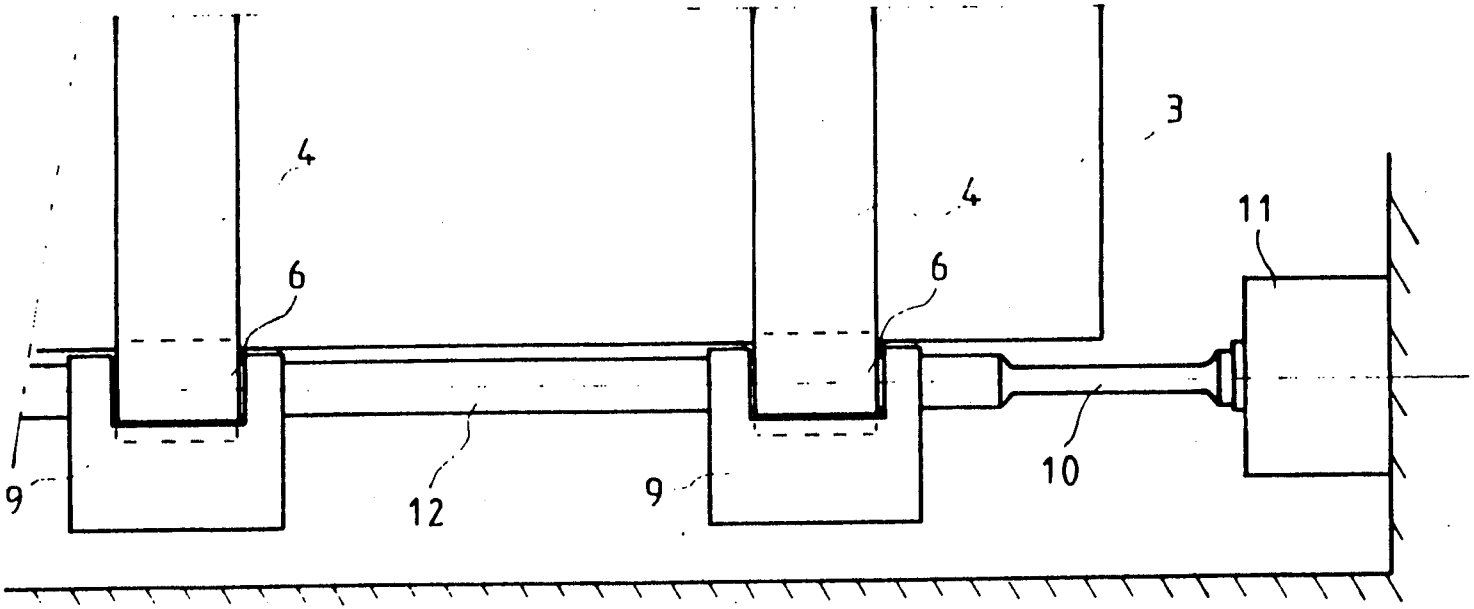
FIG. 2 is a schematic top view of a first system according to the invention.
Figure 3:
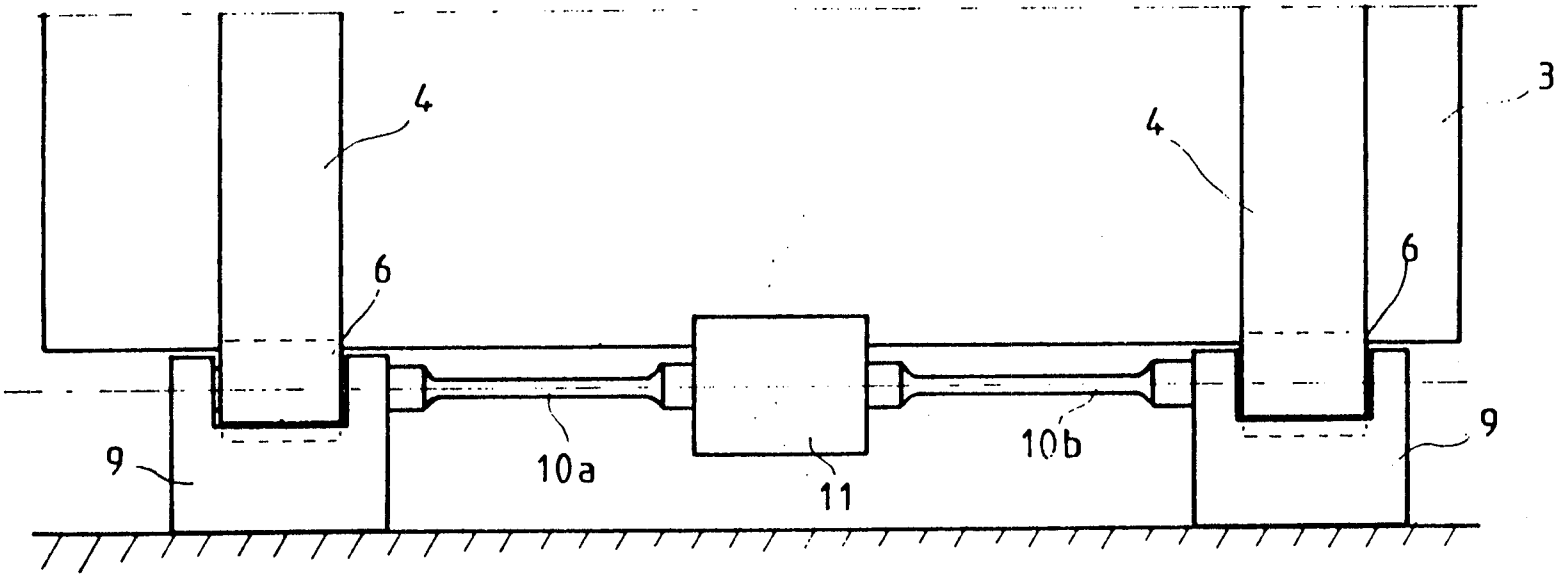
FIG. 3 is a top view, similar to that of FIG. 2, of a second system according to the invention.

The cylindrical lock element 6 is fixedly joined to a device 10 setting up a resistant torque to counter the tension exerted on the strap 4. In FIGS. 2 and 3, this device is a torsion bar 10. A torque limiter 11 is associated with the other end of the bar 10. Beyond a predetermined threshold, the torque limiter 11 releases this bar in rotation around itself.

Figure 4A:
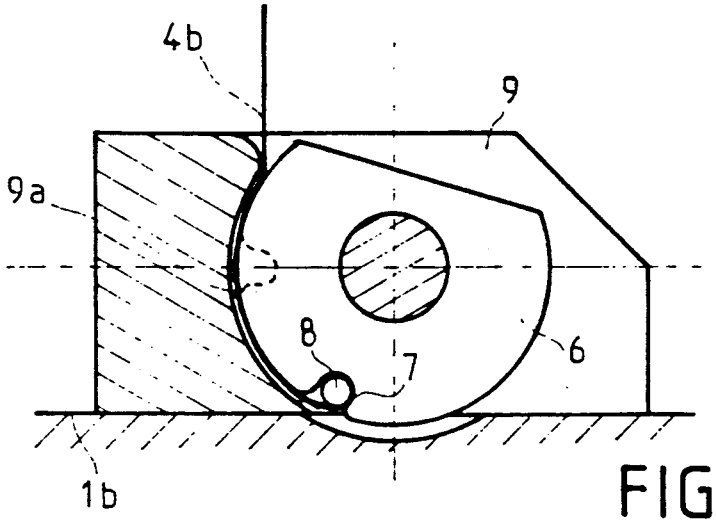
FIGS. 4*a*, 4*b*, 4*c* are schematic views of a cylindrical lock element used in the securing systems of the invention, and show the cylindrical lock element respectively an idle position, a locking position and a releasing position.

A strap 4 is positioned as follows: first of all, the element 8 which is fixedly joined by its second end 4*b* is fitted, by the side, into the groove 7 of the cylindrical lock element, in the position of FIG. 4*a*. Then the other end 4*a* of the strap is hooked to the means 5.

Figure 4B:
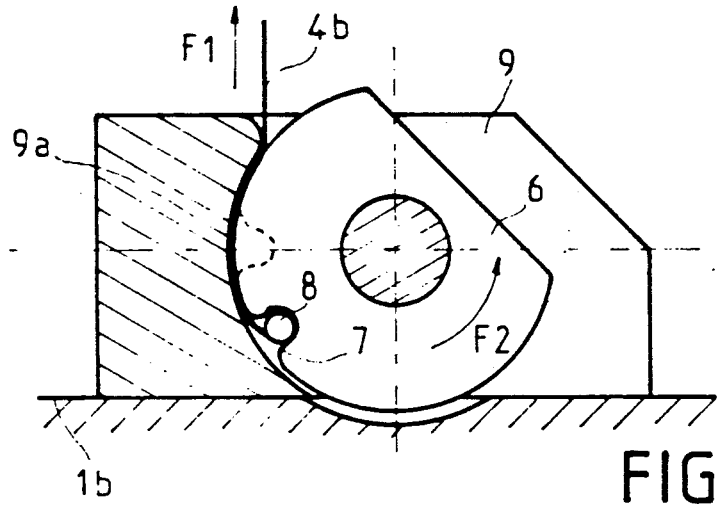

A tension represented by the arrow F1 of FIG. 4*b* is exerted on the strap 4, for example by using screws as mentioned here above. This has the effect of shifting the cylindrical lock element 6 rotationally up to a locking position (as shown in FIG. 4*b*) in opposition to the resistant torque F2 of the torsion bar 10. This locking position is quite substantially before the releasing position, illustrated by the groove 7 represented in dashes. This releasing position corresponds to the resistant torque threshold for which the device 11 releases the bar 10 in rotation about itself.

Figure 4C:
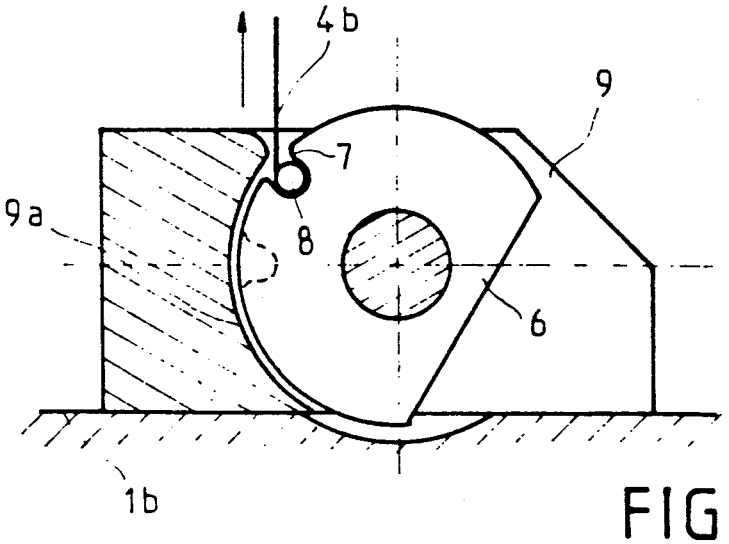

In operation, this position is crossed under the effect of the over-tension exerted on the strap 4 during the triggering of ejection produced by the ejection means. In FIGS. 4*b* and 4*c*, it can be seen that, beyond the position of release in rotation of the cylindrical lock element, the element 8 which is fixedly joined to the end 4*b* of the strap continues to be held until the groove 7 has reached the end of the wall 9*a* of the cover 9. Consequently, unlike known strap systems in which the release obtained by the breaking of the embrittled zones is instantaneous, the release in this case, which occurs in two stages, is less sudden. Furthermore, in the system of the invention, the value of the tension on the strap for which there is a release, as a function of the value of the resistant torque for which the torque limiter 11 goes into action, may be determined with far greater precision.

In the securing system of FIG. 2, the munition 3 is attached with a plurality of straps 4 distributed longitudinally, only two of which are shown. The cylindrical lock elements 6, in their respective covers 9, are all aligned and coupled together in series by means of linking bars 12. They therefore form an assembly, connected to the torsion bar 10 on the other side with respect to the torque limiter 11, in which they work in a perfectly identical and perfectly simultaneous way through the fact that, at any instant, their angular position in rotation is substantially the same for all.

In the variant of FIG. 3, the sub-munition 3 is secured only by two straps 4. Each of the two corresponding cylindrical lock elements 6 is then linked to a torsion bar of its own, referenced 10*a* and 10*b* respectively, the two bars being identical and associated with the torque limiter 11, opposite each other. During operation, with equal tension on the straps 4, the cylindrical lock elements, as in the embodiment of FIG. 2, will act in a perfectly identical and perfectly simultaneous way.

It is also possible to provide for a symmetrical arrangement of the cylindrical lock elements in relation to the torque limiter device if there are more than two cylindrical lock elements. They are then divided into two identical groups in which they are coupled by means of linking bars. Two identical torsion bars 10*a* and 10*b* are respectively associated with those ends of the two groups that are close to each other. These torsion bars such as 10*a* and 10*b* are connected, as in FIG. 3, to a torque limiting device such as 11. It must be noted that identification marks will preferably be provided on at least one of the covers of the cylindrical lock element of each group, in order to bring all the cylindrical lock elements substantially to the same angular position when the system is put under tension. Besides, identification marks such as this could be provided in all cases.

The above-described systems with several fastening points are noteworthy in that the release of all the devices (cylindrical lock elements) for securing the straps under tension is done at exactly at the same moment, and in that said release is set off by the triggering of the ejection itself. But, furthermore, owing to the fact that the cylindrical lock elements are coupled and that there is provision, beyond their angular position of release, for a range of free rotation in which the ends of the straps remain tensed, a dual effect is obtained on the release of the straps. In addition to being somewhat damped down, the release is controlled at the outset, i.e. even if, in a tensed position, the cylindrical lock elements are not all exactly in the same angular position (because, for example, of the torsion communicated to the linking bar which, although minimal, is nonetheless real), these differences are compensated for between the instant of release in rotation of the cylindrical lock elements and the instant of complete release of the straps. This is because once the resistant torque has become practically zero, said linking bars recover their original shape. Hence, the total release of all the straps takes place exactly at the same instant, i.e. with a slight delay in relation to the triggering of the ejection, the sub-munition being in an accurate position of ejection.

FIGS. 5 to 8 illustrate a development of the invention, providing for the ejection of sub-munitions with a certain angle of incidence with respect to the trajectory of the carrier, and of controlling this angle of incidence.

Figure 5:
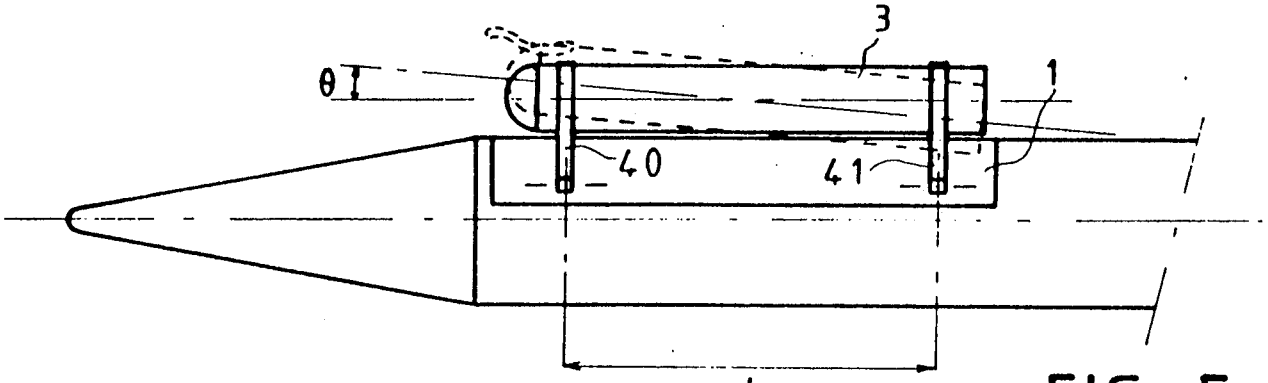
FIG. 5 is a schematic view illustrating the ejection of a sub-munition from a carrier, with an angle of incidence in relation to its trajectory, said angle of incidence being obtained by a specific arrangement of a system according to the invention.
Figure 6:
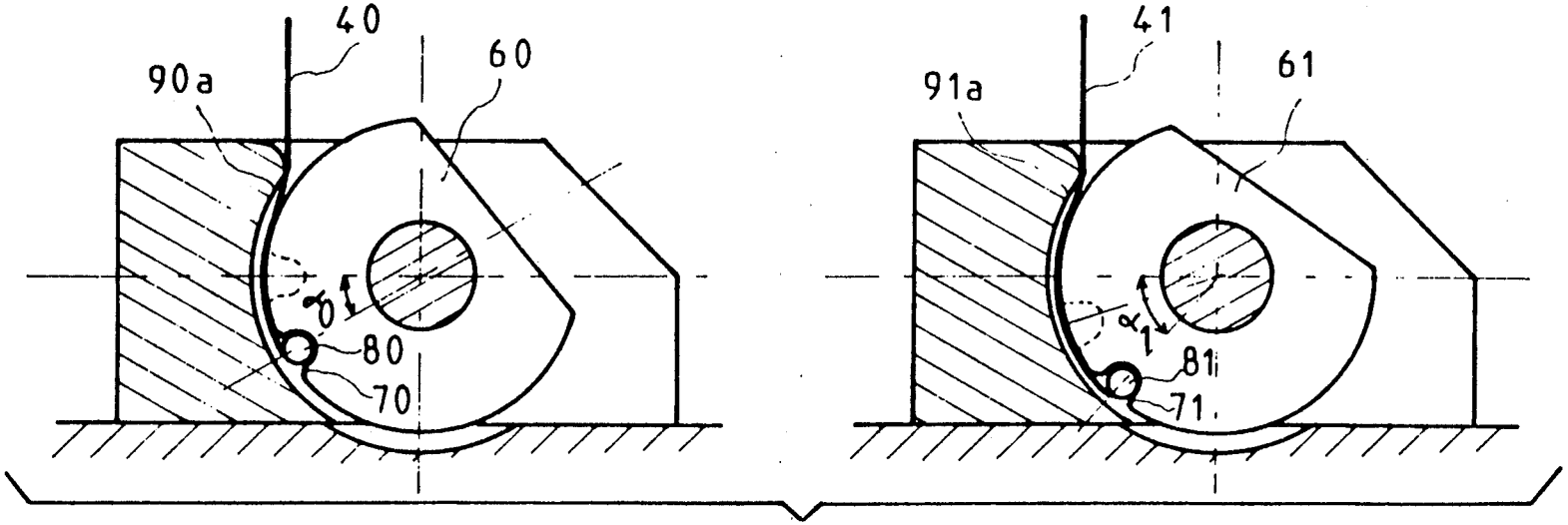
FIG. 6 shows a schematic view of an embodiment of this specific arrangement.

Before ejection, the sub-munition 3 of FIG. 5 is secured in its container 1 by a front strap 40 and a rear strap 41, to which the cylindrical lock elements 60 and 61 of FIG. 6 (or, as a variant, those of FIG. 7) correspond respectively. An ejection means such as an inflatable bag is positioned between the sub-munition 3 and the bottom of the container 1.

In FIG. 6, the cylindrical lock elements 60 and 61 are shown in the locking state. As can be seen, the angular positions of their grooves, 70 and 71 respectively, are different, i.e. the angle $\alpha_0$ is smaller than the angle $\alpha_1$ and, consequently, the angular positions of the grooves at the instant of unlocking, shown in dashes, is offset to the same extent. The result thereof is that, starting from the simultaneous unlocking of the two cylindrical lock elements, the angular paths travelled by the grooves 70 and 71, and hence of the elements 80 and 81 at the ends of the straps 40 and 41, up to complete release on passing the upper ends of the walls 90*a*, 91*a*, will be different. As a consequence, one of the straps, in this case the front strap 40, will be totally released before the other one, at an instant $t_1$ when the sub-munition 3 is in the position shown in solid lines in FIG. 5. In the period $\Delta t$ between the instant of total release $t_2$ of the second strap 41 and the instant $t_1$, the ejection means will communicate a certain angle of incidence $\theta$ to the sub-munition 3, the value of which will depend, firstly, on the difference $\alpha_1-\alpha_0$ and, secondly, on the divergence L between the straps 40 and 41.

Should the two cylindrical lock elements 60 and 61 be mounted in a system such as that of FIG. 2, i.e. joined by a linking bar 12, the angular offset will be obtained during assembly. Furthermore, the strap 40 will be designed to be slightly shorter than the strap 41.

In the other assembly, shown in FIG. 3, the offset will be obtained, here again, with straps of different lengths, in stretching one of the straps more than the other one. Or else, if it is preferred that the tensions of the two straps should be substantially equal, the offset will be obtained by choosing torsion bars 10*a* and 10*b* that are not identical.

Figure 7:
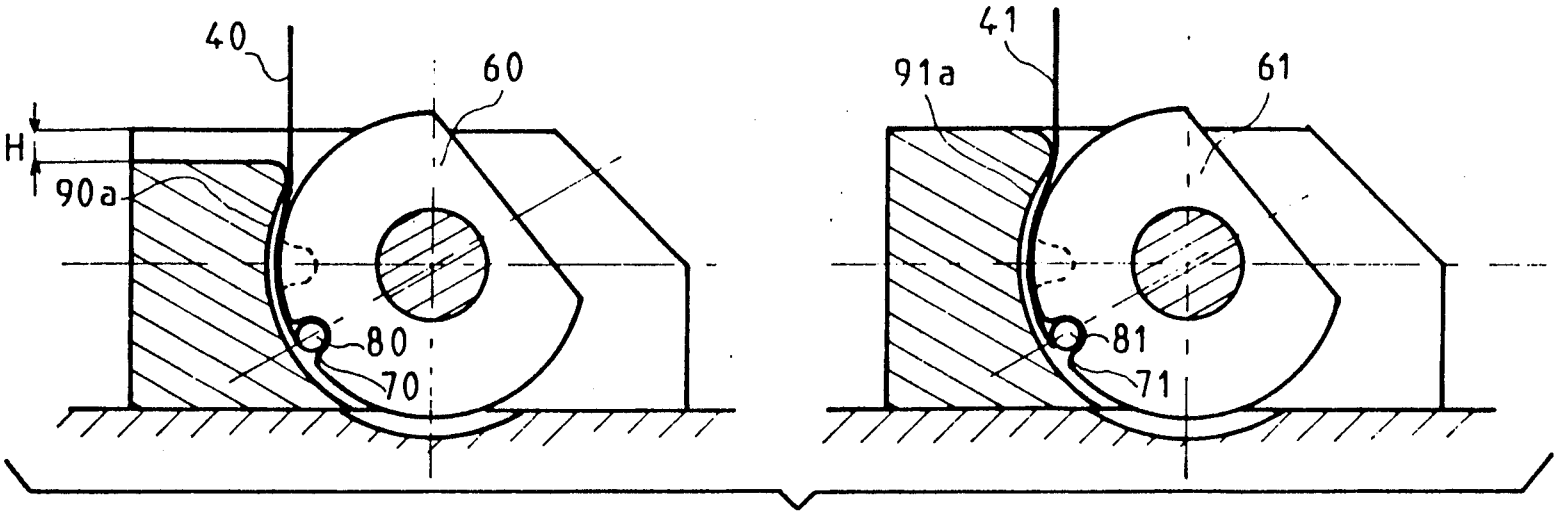
FIG. 7 shows another embodiment of this specific arrangement.

FIG. 7 illustrates another means of obtaining a complete deferred release of the two straps 40 and 41. Here, the difference in the angular path travelled by the elements 80 and 81 between the unlocking position and the position of total release is obtained through the fact that the walls 90*a* and 91*a* of the covers 90 and 91 stop at different heights. The value of the angle of incidence communicated to the sub-munition is then a function of the difference in height H (FIG. 7) and of the distance L between the straps 40 and 41. In this embodiment, the cylindrical lock elements 60 and 61 are mounted and used exactly as in the systems of FIGS. 2 and 3.

In a sub-munitions securing system with more than two straps, for an ejection with a controlled angle of incidence, it should be provided that only one of the straps, preferably close to one end of the sub-munition, is completely released after all the others.

Figure 8:
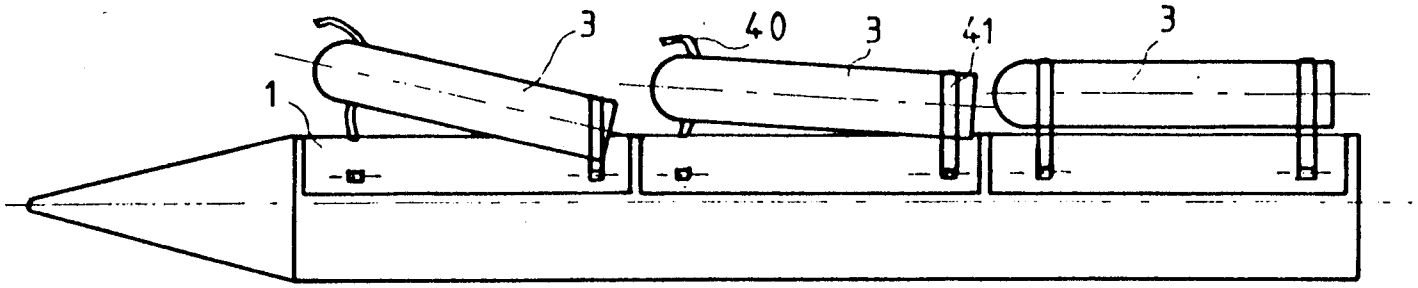
FIG. 8 is a view representing the simultaneous ejection, from a carrier, of several sub-munitions with different angles of incidence.

An application in which the arrangement that has just been described is particularly advantageous is shown in FIG. 8. A carrier conveys a plurality of sub-munitions 3, which have to be ejected simultaneously. By communicating different angles of incidence to them at ejection, the system achieves a better distribution and, by this very fact, a more efficient dispersal over the zone to be saturated.

As compared with known systems, the invention further provides substantially improved conditions for the securing and ejection of sub-munitions. It therefore offers a wider range of possibilities with the already mentioned additional advantage wherein no arrangement is necessary for the sub-munition itself.

What is claimed is:

1. A system for securing sub-munitions placed on board a carrier, each in a container, and using straps, wherein each strap is fixed by a first end to a wall of a container through means for placing said strap under tension, said system further comprising a cylindrical lock element, mounted in another wall of said container, the second end of said strap comprising means of engagement in said cylindrical lock element, said lock element being connected to a device for generating a countering resistant torque during a rotation of the cylindrical lock element in the direction in which the strap is put under tension, said system further comprising a torque limiter which is triggered at a determined threshold value, said resistant torque generator device being connected to said torque limiter whereby the lock element is released when said strap is put under tension beyond said threshold in order to release said second end of the strap.

2. A system according to claim 1, further comprising linking bars for coupling in series all the cylindrical lock elements, the assembly of cylindrical lock elements being connected to a single resistant torque generating device, said torque limiter being associated to said single resistant torque generating device.

3. A system according to claim 1, wherein the cylindrical lock elements are divided into two identical groups in each of which they are coupled in series, the two groups being linked respectively to each of two identical resistant torque generating devices, connected to a single torque limiter, on either side of it.

4. A system according to claim 1, comprising two cylindrical lock elements, respectively connected to each of the two identical resistant torque generating devices, which are connected to a single torque limiter, on either side of it.

5. A system according to claim 1, wherein said resistant torque generator devices are torsion devices.

6. A system according to claim 1, wherein the devices for placing the straps under tension are screw devices.

7. A system according to claim 1, wherein of each cylindrical lock element comprises a cover, said cover having means for securing the end of the corresponding strap in each cylindrical lock element, said securing means acting up to a position beyond the position reached when the cylindrical lock element is released in rotation by the torque limiter.

8. A system according to claim 7, comprising at least two straps, wherein said engagement means of each strap is positioned in a groove provided in said cylindrical lock element, and wherein in the cylindrical lock element assigned to one of the straps, the angular path travelled by the groove between the position that it occupies at the unlocking of the cylindrical lock elements and its position of complete release of the straps, facing the end of the securing means, is longer than in the cylindrical lock elements assigned to the other straps in order that, during ejection, an angle of incidence with respect to the trajectory of the conveyance vector is communicated to the sub-munition.

* * * * *